US006135814A

United States Patent [19]

Fischer et al.

[11] Patent Number: 6,135,814

[45] Date of Patent: Oct. 24, 2000

[54] CEILING SOCKET FOR CEILING LIGHTS

[75] Inventors: Hans Fischer, Asbecker Strasse 6, Balve; Ulrich Bockemühl; Bernd Paulmann, both of Lüdenscheid, all of Germany

[73] Assignees: Hans Fischer, Balve; Spritzguss-Werk Ludenscheid GmbH, Ludenscheid, both of Germany

[21] Appl. No.: 09/341,394

[22] PCT Filed: Jan. 8, 1998

[86] PCT No.: PCT/DE98/00044

§ 371 Date: Jul. 12, 1999

§ 102(e) Date: Jul. 12, 1999

[87] PCT Pub. No.: WO98/30836

PCT Pub. Date: Jul. 16, 1998

[30] Foreign Application Priority Data

Jan. 11, 1997 [DE] Germany ..... 197 00 730

[51] Int. Cl.[7] ..... H01R 13/60; H01R 13/66

[52] U.S. Cl. ..... 439/576; 439/529

[58] Field of Search ..... 439/529, 576, 439/542, 543, 533, 535, 351; 362/250; 348/399, 301, 303, 304

[56] References Cited

U.S. PATENT DOCUMENTS 2,671,821 3/1954 Zientowski et al. ..... 439/576

FOREIGN PATENT DOCUMENTS 9012349 12/1990 Germany .

*Primary Examiner*—Renee Luebke
*Assistant Examiner*—Antoine Ngandjui
*Attorney, Agent, or Firm*—Edwin D. Schindler

[57] ABSTRACT

A ceiling socket for ceiling lights includes a socket 25 and of a support piece 5, which is accommodated therein and has electrical clamping contacts. The support piece 5 is assigned a pivotably articulated suspension hook 6 which, in its use position, is folded out, pointing away from the ceiling, and, in its non-use position, is arranged with its suspension portion 14 parallel to the surface of the support piece 5. The suspension hook 6 has an anchoring piece 7 which is displaceably mounted in a guide 26 assigned to a fastening piece 27. In its non-use position, the anchoring piece 7 of the suspension hook 6 is arranged eccentrically in relation to the suspension position, which is arranged substantially centrically relative to the ceiling socket 1.

7 Claims, 4 Drawing Sheets

CEILING SOCKET FOR CEILING LIGHTS

BACKGROUND OF THE INVENTION

1. Technical Field of the Invention

The invention relates to the technical field of ceiling sockets having a suspension hook for suspending lights. Especially, the invention relates to a ceiling socket for ceiling lights with a socket, with a support piece, which is accommodated therein and has electrical clamping contacts and on which is articulated a pivotably arranged suspension hook having an anchoring piece.

2. Description of the Prior Art

Such a ceiling socket is known from German Utility Model 90 12 349.2. This previously known ceiling socket comprises a socket, which can be inserted in the ceiling, a support piece, which is made of plastics material, is accommodated in said socket and has electrical clamping contacts, a covering plate, which can be secured in said support piece, and a suspension hook, which can be folded down, is held on the support piece and projects outwards through the covering plate. The suspension hook projects outwards through a T-shaped opening of the covering plate and in the non-use position can be folded down by its anchoring part into a depression formed in the covering plate. In the use position, the suspension hook is pivotable into a suspension position perpendicular to the covering plate.

The anchoring part of the suspension hook is articulated in a centered manner in relation to the socket or the support piece, so that in its use position the suspension hook projects centrically down from the ceiling socket. The centered articulation of the suspension hook means that the radius of such a ceiling socket is decisively governed by the size of the suspension hook. Owing to the requirements imposed to the suspension hook with regard to its load carrying, said suspension hook can scarcely be constructed with smaller dimensions, even if the aim is to provide a ceiling socket as small as possible for load carrying of the same size. It is desirable to construct ceiling sockets as small as possible in order not to detract from the design of a ceiling light with an oversize ceiling socket. From the DE 27 30 859 A1 is known a further ceiling socket. Said known ceiling socket comprises ceiling plaster in the center of which is arranged an electrical socket. The suspension hook comprises a joint by which said suspension hook may be divided in an anchoring part—said part extends into the plug—and an suspension part—said hook-shaped part in which the light can be suspended. The suspension part is connected to the anchoring part by a joint so that in the non-use position the suspension part rests flat on the upperside of the socket and in the use position said part is swing out and extends downwards adjacent to the socket. In order that the suspension part, the anchoring part of which is arranged beneath the socket is designed still extending to the middle part of the socket, has a bending so that the suspension hook is Z-shaped in the use position. A disadvantage of such a ceiling socket is that the suspension hook in the use position is not arranged in a center position with regard to the socket. Since it is desirable to arrange a light centered underneath a canopy such a centered arrangement for the user can be effected that the canopy is designed in such dimension the ceiling socket is arranged excentrically with regard to the periphery of the canopy on the one side or that the light is centered by the lower central opening of the canopy on the other side. The last possibility is not satisfactory since a correction by the canopy is not possible for heavy lights. The proposal of large-scaled canopies—according to the first possibility—is normally unwanted since the user is directed to the optical effect of the light and not of the canopy.

SUMMARY OF THE INVENTION

Starting from this prior art discussed, the object on which the invention is based therefore is to propose a ceiling socket for ceiling lights which is usable not only for use with large load carrying, but at the same time has dimensions as small as possible.

This object is achieved according to the invention in that the anchoring part of the suspension hook is displaceably arranged in a guide, by means of which the suspension hook can be moved from a suspension position into a non-use position at a distance from the suspension position.

In the case of the ceiling socket according to the invention too, there is provision for the anchoring piece of the suspension hook, in its suspension position, to be arranged substantially centrically in relation to the socket or the support piece. However, since the anchoring piece is not stationarly articulated, but is displaceable in a guide, the suspension hook can be pushed by its anchoring piece into a non-use position, the anchoring piece being arranged eccentrically in the non-use position. The anchoring piece is located, in the non-use position, at a distance from the substantially centric suspension position. In contract to the ceiling socket according to the acknowledged prior art, the size of the suspension hook does not decisively govern the radius of the ceiling socket any longer, but not only the diameter of the same. Ceiling sockets of this type can therefore be constructed considerably smaller than the aforementioned ones.

In an exemplary embodiment, there is provision for the anchoring piece to be of T-shaped construction and, for guiding, for it to engage in a fastening piece of U-shaped construction, in the opposite legs of which there is formed in each case an elongated-hole-like opening, one end of which defines the suspension position and the other end of which defines the non-use position of the suspension hook. Expediently, such an elongated-hole-like guide is constructed with an inclination towards the socket or the ceiling from its suspension position to the non-use position. Such an arrangement ensures that the unfolded suspension hook is always located, at least when under load, in the prescribed suspension-position end of the guide.

For better fixing of the suspension hook in its non-use position, there is provision, in a development, for the non-use-position end of the elongated-hole-like guide to correspond, in diameter, substantially to the diameter of the anchoring piece of the suspension hook. The clear width of the remaining guide portions is constructed, in contrast, with a certain play in relation to the diameter of an anchoring piece, in order to prevent tilting during the unfolding movement of the suspension hook.

It is advantageous to construct the suspension hook is an angled manner, with the hook position of the suspension hook angularly adjoining the anchoring piece. The hook portion of the suspension hook can then be arranged, in its folded-in position, substantially flush with the outside of the support piece cover.

BRIEF DESCRIPTION OF THE DRAWING FIGURES

Further advantages and development of the invention are contained in further subclaims and in the following description of an exemplary embodiment, in which:

FIG. 1 shows a plan view of a ceiling socket partly in section with the suspension hook folded in.

DETAILED DESCRIPTION OF THE DRAWING AND PREFERRED EMBODIMENTS

Figure 1:
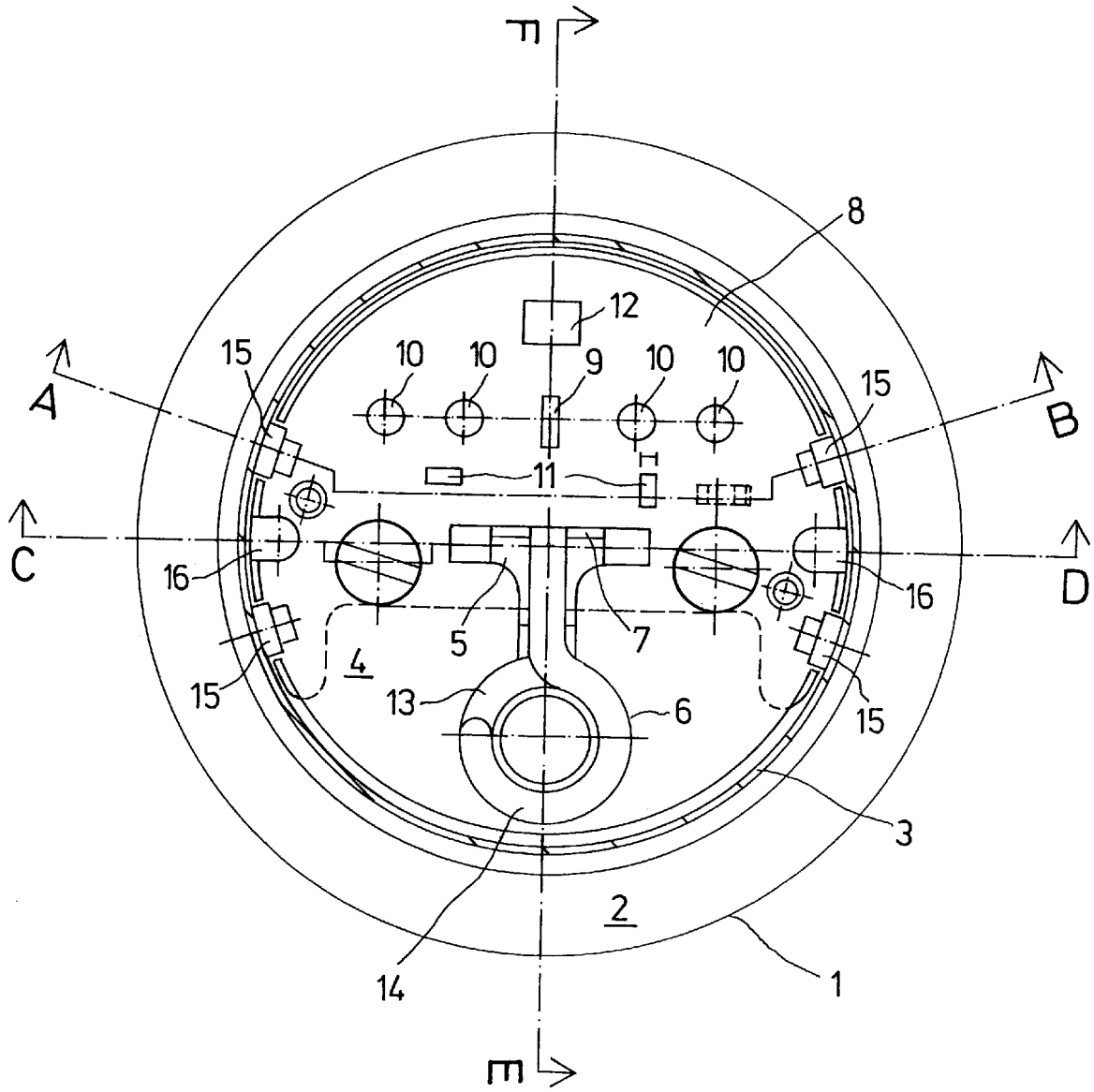

FIG. 1 shows a ceiling socket 1 with a covering frame 2, a canopy 3 and a covering plate 4 provided as the support piece cover. Arranged beneath the covering plate 4 is a support piece 5, in which a suspension hook 6 is pivotably articulated by its anchoring part 7. The covering plate 4 has a plug-specific openings 8 to allow plug contact pins of a plug to reach through in order to establish an electrical contact with the electrical clamping contacts assigned to the support piece 5. The opening 9 which is central in relation to the plug arrangement 8 is provided for the introduction of the plug contact pin provided for the protective conductor. For universal use of the ceiling socket 1, openings 10, 10' adjacent to the opening 9 are provided. Two further openings 11 serve for the noninterchangeable insertion of a plug. The opening 12 is provided for locking an inserted plug by means of a latching bow.

Also formed in the covering plate 4 is a hook receptacle 13, into which the suspension hook 6 can be folded in its non-use position by its holding portion 14.

At the edge, the covering plate 4 is assigned latching feet 15 which are provided both for fixing the covering plate 4 on the support piece 5 and for holding the covering frame 2. Formed between the latching feet 15, which are arranged in pairs, there is in each case a servicing aperture 16, in which it is possible to engage a tool if the holding position of the covering frame 2 is to be changed or if the covering frame 2 is to be removed from the ceiling socket 1.

Figure 2:
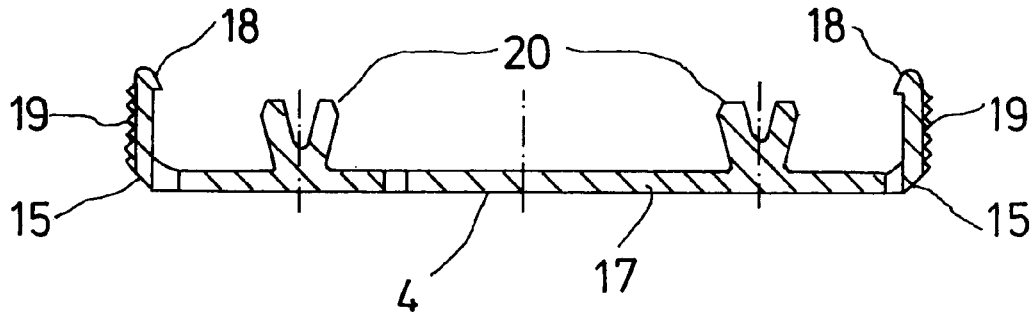
FIG. 2 shows a section along the line A–B through the support cover shown in FIG. 1.

The configuration of the latching feet 15 can be seen from the sectional representation of FIG. 2. The latching feet 15 are integrally moulded on the base plate 17 of the covering plate 4 at the edge. The ends of the latching feet 15 are provided with a latching nose 18 constructed in the manner of a barb, said latching noses engaging in an undercut located on the support piece 5. Furthermore, the covering plate 4 has latching elements 20 of peg-like action which engage in corresponding bores of the support piece 5 and serve for fastening the covering plate 4 on the support piece 5. Grooving 19 is formed in the latching feet 15, on the outside, serving for fixing the covering frame 2.

Figure 3:
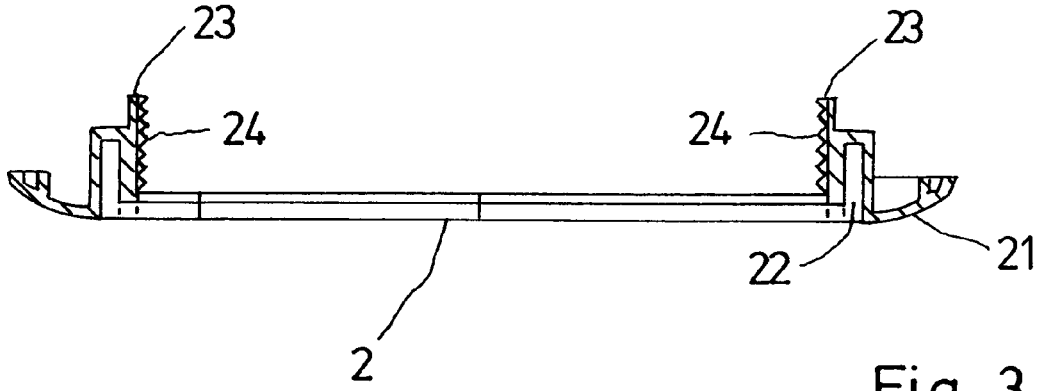
FIG. 3 shows a section along the line C–D of FIG. 1 through the covering frame illustrated in this figure.

The covering frame 2, shown in section in FIG. 3, consists essentially of a rosette-like covering rim 21, the underside of which is provided for resting against the ceiling, of a canopy receptacle 22 of slot-like construction and of holding feet 23 attached at positions corresponding with the latching feet 15 of the covering plate 4. Grooving 24 is likewise formed in the holding feet 23, on the inside, corresponding to the grooving 19. On mounting the covering frame 2, the grooving 24 of the holding feet 23 then engages in the grooving 19 of the latching feet 15, so that the covering frame 2 can be securely fastened. Through this cooperation of the two groovings 19, 24, it is possible to adjust the covering frame 2 with respect to its distance from the covering plate 4, in accordance with the particular requirements.

Figure 4:
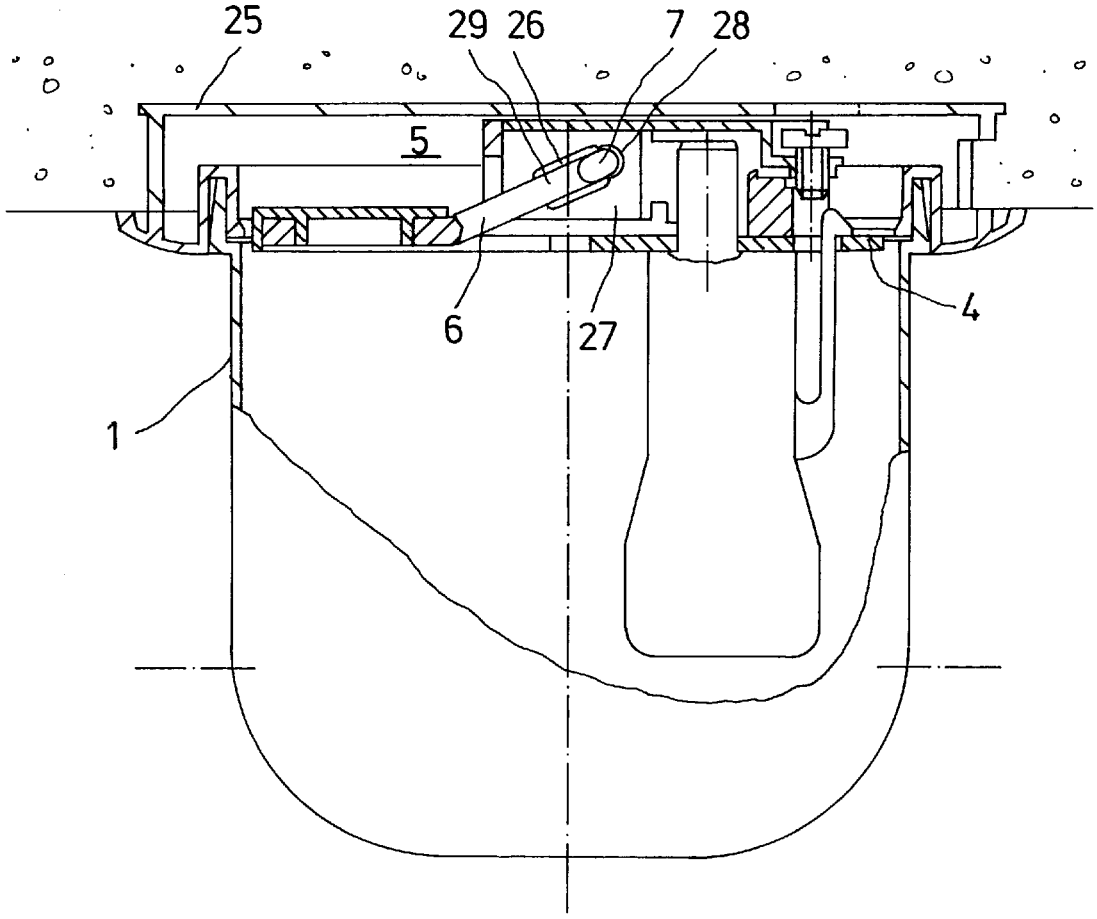
FIG. 4 shows the ceiling socket of FIG. 1 in a sectional representation in accordance with the section line E–F of FIG. 1

The installed ceiling socket 1 is illustrated in FIG. 4. It also becomes clear from this figure that the ceiling socket 1 is assigned a socket 25 which, in the exemplary embodiment illustrated, is constructed as a flush socket. Accommodated in the socket 25 is the support piece 5, which is assigned, on the one hand, the electrical clamping contacts, of which the clamping contact assigned to the protective conductor is depicted in FIG. 4, and, on the other hand, the suspension hook 6 with a fastening piece 27 having a guide 26. The support piece 5 and the covering plate 4 are made of a plastics material conforming to VDE standards. The fastening piece 27 is made of metal.

The guide 26 of the fastening piece 27 is constructed as an elongated hole, in which the anchoring part 7 of the suspension hook 6 is displaceably guided. FIG. 4 shows the suspension hook 6 in its folded-in non-use position, so that the anchoring part 7 is located at the non-use and 28 of the opposite guides 26. This end 28 is adapted in its width substantially to the diameter of the anchoring part 7, in order that the suspension hook 6 is fixed in this position. The clear width of the remaining portions of the guide 26 are constructed larger, with sufficient play, than the diameter of the anchoring part 7. To ensure that the suspension hook 6 is arranged at the prescribed end 29 in its unfolded functional position, the guide 26 is constructed with an inclination towards the socket 25 starting from its end 29.

Figure 5:
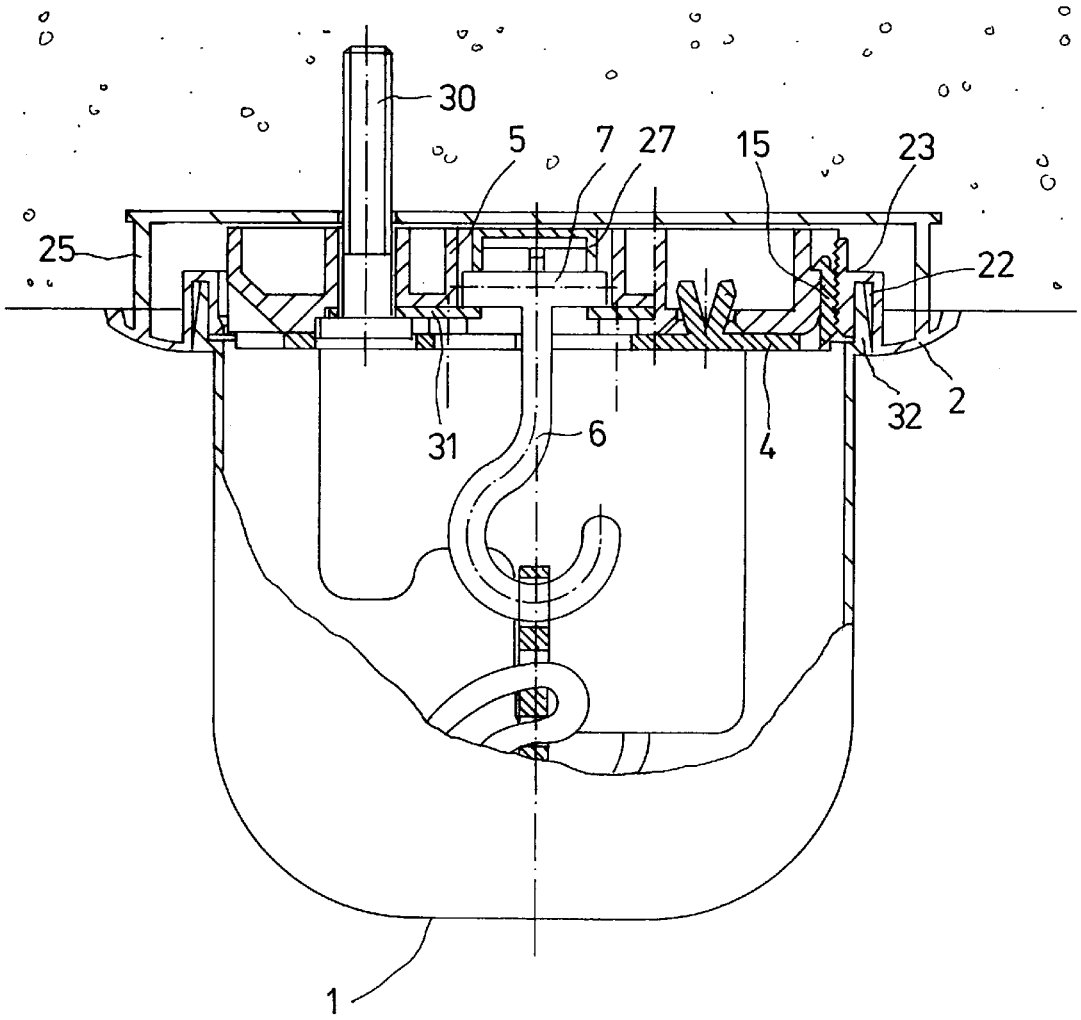
FIG. 5 shows the ceiling socket of FIG. 1 in a section C–B of FIG. 1.

The ceiling socket 1 is again depicted in FIG. 5, in a section plane displaced by 90 degrees. The T-shaped construction of the anchoring part 7 of the suspension hook 6 can be seen from this figure. The suspension hook 6 is located, together with its anchoring part 7, in its suspension position in the figure shown. The upper end of a ceiling light (not illustrated any further) is suspended from the hook 6. Fastening screws 30, one of which can be seen in FIG. 5, are provided for fastening the support piece 5 on the ceiling side. The fastening screws 30 also reach through fastening tabs 31 assigned to the fastening piece 27, so that the force taken up by the suspension hook 6 is carried off directly into the ceiling.

The cooperation of a latching foot 15 with a holding foot 23 of the covering frame 2 can be seen from the sectional representation shown. It becomes clear from this interaction that the covering frame 2 can be adjusted in relation to the covering plate 4 such that the outer edge of the covering frame 2 rests on the surface of the ceiling. Such adjustability is convenient if the socket 25 has already been installed and the final ceiling finish has not yet been applied. For a flush finish of the socket 25 with the surface of the ceiling, it is now no longer necessary to have to take account of the ceiling coating which will ultimately be used as early as during the installation of the socket 25.

The canopy 3 has a tapering plug-in edge 32. This plug-in edge 32 is inserted into the canopy receptacle 22 of the covering frame 2 and frictionally held therein.

LIST OF REFERENCE SYMBOLS

1 Ceiling socket
2 Covering frame
3 Canopy
4 Covering plate
5 Support piece
6 Suspension hook
7 Anchoring part
8 Opening

9 Opening
10 Opening
11 Opening
12 Opening
13 Hook receptacle
14 Holding portion
15 Latching foot
16 Service aperture
17 Base plate
18 Latching nose
19 Grooving
20 Latching element
21 Covering rim
22 Canopy receptacle
23 Holding foot
24 Grooving
25 Socket
26 Guide
27 Fastening piece
28 Guide end
29 Guide end
30 Fastening screw
31 Fastening tab
32 Plug-in edge

What is claimed is:

1. A ceiling socket for ceiling lights, comprising:

a socket;

a support piece capable of being accommodated within said socket and having electrical clamping contacts securable to a ceiling;

an elongated guide;

a suspension hook having an anchoring piece, said anchoring piece having a T-shaped construction and engages said elongated guide, said suspension hook including means for rendering said suspension hook movable and pivotable from a suspended use position on a first side end to a non-use position distal from the suspended use position at a second side end.

2. The ceiling socket for ceiling lights according to claim 1, wherein said elongated guide is arranged with an inclination toward said socket.

3. The ceiling socket for ceiling lights according to claim 1, wherein one end of said elongated guide, which defines the non-use position, corresponds in its clear width substantially to a diameter of said anchoring piece of said suspension hook, while remaining portions of said elongated guide have a large width than the diameter of said anchoring piece.

4. The ceiling socket for ceiling lights according to claim 1, wherein said suspension hook angularly adjoins said anchoring piece by a holding portion of said suspension hook.

5. The ceiling socket for ceiling lights according to claim 1, wherein said suspension hook is pivotably held by said anchoring piece in said elongated guide.

6. The ceiling socket for ceiling lights according to claim 1, further comprising a fastening piece having a U-shaped construction with opposite legs being formed by the U-shaped construction, in each of the opposite legs is provided an elongated opening, said anchoring piece being guidable by, and engagable in, the elongated openings of said fastening piece.

7. The ceiling socket for ceiling lights according to claim 6, wherein said support piece is fastened to the ceiling via fastening screws, with said fastening piece being simultaneously held by said fastening screws.

* * * * *